US005706875A

United States Patent [19]

Simon

[11] Patent Number: 5,706,875

[45] Date of Patent: Jan. 13, 1998

[54] MECHANISM FOR DETECTING AN OBSTACLE PREVENTING THE PROPER OPERATION OF A ROLLER-TYPE DOOR WITH SECTIONAL SHUTTERS

[75] Inventor: Bernard Simon, Caluire, France

[73] Assignee: Mavil, Liernais, France

[21] Appl. No.: 719,678

[22] Filed: Sep. 26, 1996

[30] Foreign Application Priority Data

Sep. 26, 1995 [FR] France ..... 95 11537

[51] Int. Cl.[6] ..... E05F 15/20

[52] U.S. Cl. ..... 160/8; 160/1; 160/310; 160/291; 242/563

[58] Field of Search ..... 160/1, 8, 310, 160/291, 3; 242/563

[56] References Cited

FOREIGN PATENT DOCUMENTS 1274323 12/1964 Germany ..... 160/310

4166591 6/1992 Japan ..... 160/8

548523 4/1974 Switzerland .

*Primary Examiner*—Blair Johnson

*Attorney, Agent, or Firm*—Dowell & Dowell

[57] ABSTRACT

A mechanism for detecting an obstacle preventing the proper operation of a sectional shutter of a warehouse-type door which includes a detection member mounted in the vicinity of a horizontal shaft around which the sectional shutter is wound by the operation of a motor. The detection mechanism is connected to a switch for controlling the motor and thus the rotation of the horizontal shaft about which the sectional shutter is wound. The detection member consists of at least one member which extends adjacent to but spaced from the horizontal shaft and which is engageable by a slack portion of the sectional shutter caused by the engagement of an obstacle with the sectional shutter as it is being lowered.

13 Claims, 3 Drawing Sheets

MECHANISM FOR DETECTING AN OBSTACLE PREVENTING THE PROPER OPERATION OF A ROLLER-TYPE DOOR WITH SECTIONAL SHUTTERS

BACKGROUND OF THE INVENTION

1. Field of the Invention

The present invention relates to a mechanism for detecting an obstacle preventing the proper operation of a warehouse-type roller door with sectional shutter.

2. History of the Related Art

Detection mechanisms are known that are designed to actuate the lifting of a roller door when it encounters an obstacle during its lowering. The mechanisms are housed under a threshold-bar made of metal. The mechanisms consist of a pressure sensor system applied continuously all the way across the threshold-bar.

Other detection mechanisms are known that consist of an elongated, flexible casing having an attachment plate integral with the widest free edge of the flexible roller blind. The elongated casing comprises a conduit running its entire length and containing at its opposite ends a transmitter and a receiver for a light ray that follows a course parallel to the free edge of the flexible roller blind. As soon as the casing undergoes a slight deformation, the ray is interrupted, triggering the stopping of the roller door's movement.

A disadvantage of these detection mechanisms is their high production cost; in addition, they do not allow the detection of an obstacle applied against the blind or the sectional shutter during its lowering, for example a mass putting pressure on the blind or a cart laterally pushing aside the threshold-bar.

In these situations the obstacle cannot be detected by the detection mechanisms such as the pressure sensor situated on the threshold-bar.

Finally, these detection mechanisms placed in the threshold-bars are quite heavy and relatively rigid, thus inappropriate for use with warehouse-type roller doors.

From patent CH-A-548 523 an obstacle detection mechanism is known in which two switches are arranged above and, respectively, below the winding shaft of a rolling shutter. Each switch is associated with a trigger and with a spring, making the mechanism complex. In addition, this mechanism can react to the forming of a loop only opposite the triggers of a switch, i.e., above or below the winding shaft. Indeed, the triggers are sensitive over a small angular range in relation to the shutter's winding axis. If a loop or a slack forms in an area far from the triggers, the mechanism reacts only when the loop has developed such that it reaches one of the triggers, and this can occur well after the forming of the loop. The safety function sought with this mechanism is thus not fully achieved.

The present invention is intended, more specifically, to remedy these disadvantages.

SUMMARY OF THE INVENTION

In this spirit, the invention relates to a mechanism for detecting an obstacle preventing the proper operation of the sectional shutter of a warehouse-type roller door, comprising detection means arranged in the vicinity of the horizontal shaft around which the sectional shutter winds. The detection means is connected to a position switch controlling the rotation of the horizontal shaft, characterized in that the detection means consist of at least one strap arranged perpendicular to the horizontal shaft and in its vicinity. The strap is connected on the one hand to the position switch and, on the other hand, to a fixed plate or to a face of a hood integral with lateral members.

Thanks to the invention, the mechanism can react effectively to an obstacle in the path of the rolling shutter by detecting the forming of a loop over a wide angular range in relation to the axis of the door's winding shaft. The use of a strap guarantees that the forming of a loop does not deform the hinged lever of the switch, because the strap absorbs the changes in volume of the sectional shutter.

According to an advantageous aspect of the invention, the fixed plate and the position switch are attached perpendicular to each other inside a hood. Thus, the strap extends over an angle greater than 90°, making the mechanism effective over a wide angular range.

According to another advantageous aspect of the invention, the strap has an appreciably curved profile. Thanks to this aspect of the invention, the strap is formed to receive a loop formed by the shutter when it is slack.

According to another advantageous aspect of the invention, the position switch comprises a lever that swings under the effect of the tension of the strap. Thus, the lever that controls the switch is not in contact with a slack formed by the shutter and is not in danger of being deformed by a stress due to such a slack.

BRIEF DESCRIPTION OF THE DRAWINGS

The attached drawing, given as an example, makes it possible to better understand the invention, the characteristics it presents and the advantages it is apt to provide.

DESCRIPTION OF THE PREFERRED EMBODIMENT

Shown in FIGS. 1 through 4 are a warehouse-type roller door 1 comprising a roller blind or sectional shutter 1*a* windable around a horizontal shaft 1*b* that is caused to rotate by a geared motor shown generally at "M".

The warehouse-type roller door 1 consists of lateral members 1*c* comprising a vertical slide 1*d* in which the sectional shutter 1*a* slides. The sectional shutter comprises at its lower end a basically known threshold-bar 1*e*.

The warehouse-type roller door 1 comprises in its upper part a hood if integral with the members 1*c* and that can be provided all the way across the shaft 1*b*.

Provided in the inside part of the hood 1*f* and above each member 1*c* is a fixed plate 1*g* directed in the direction of the horizontal shaft 1*b*. The fixed plate 1*g* is arranged below the shaft 1*b* and in its vicinity. The hood if comprises on one of its inside faces and, more specifically, on a face situated perpendicular to the fixed plate 1*g*, a position switch 1*h* that is electrically connected to the geared motor causing the horizontal shaft 1*b* to rotate. The position switch 1*h* comprises a hinged lever 1*i* that is integral with a flexible strap 1*j* the opposite end of which is attached on the tip of the plate 1*g*, i.e., below the horizontal shaft.

The strap 1*j* takes on a slightly curved profile running below and in the vicinity of the horizontal shaft 1*b*. Obviously, another strap 1*j* can be mounted at the other end of the shaft 1*b* of the warehouse-type roller door 1.

Figure 4:
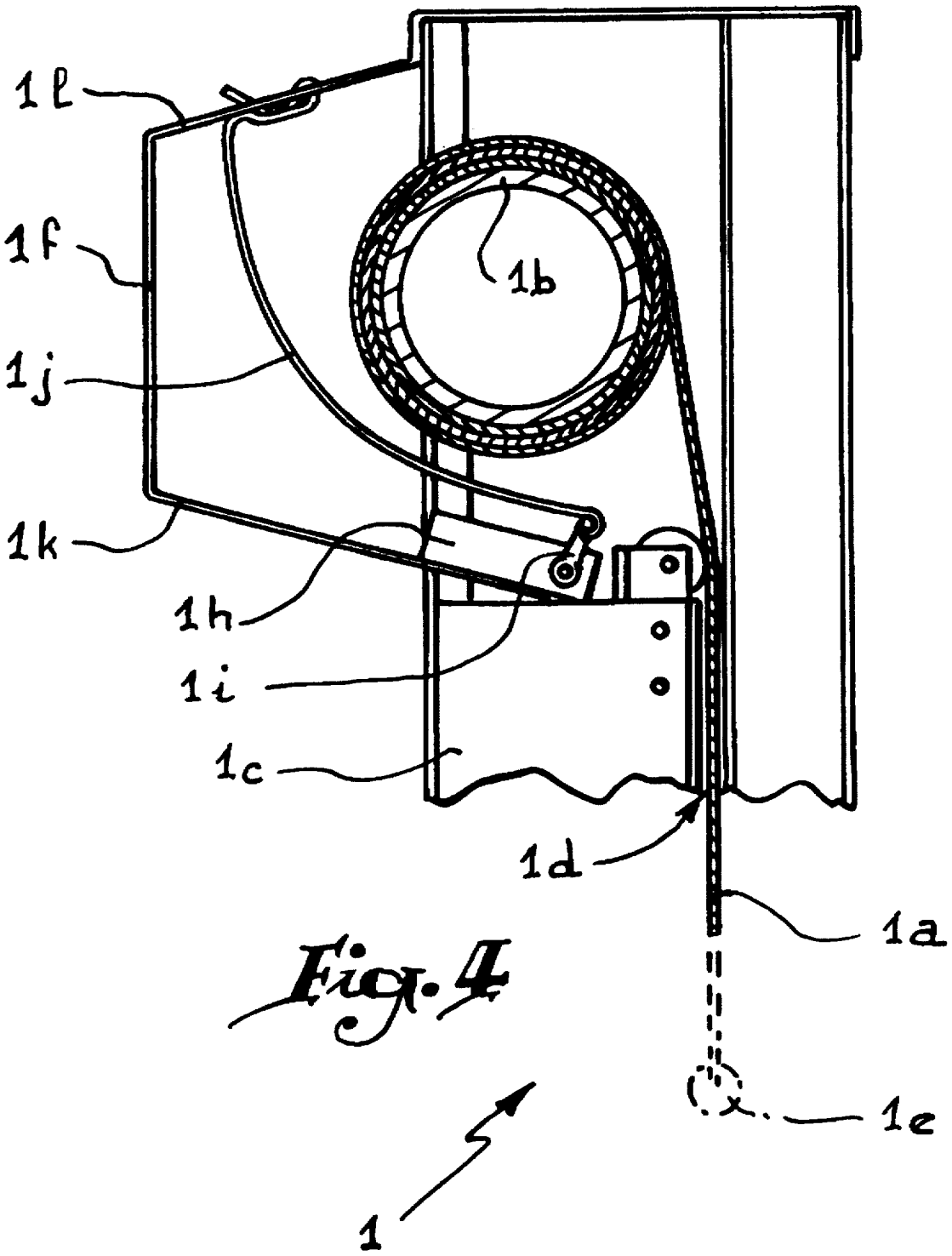
FIG. 4 is a view similar to that of FIG. 2, but showing a variating in positioning of the detection mechanism according to the invention.

FIG. 4 shows a variant of a detection mechanism according to the present invention wherein the positioning switch 1*h* receiving one of the ends of the flexible strap 1*j* is attached on the lower face 1*k* of the hood 1*f*.

The other end of the flexible strap 1*j* is directly secured to the upper face 11 of the hood 1*f* in such a way that the strap is perpendicular and in the vicinity of the horizontal shaft 1*b* of the warehouse-type roller door 1.

According to the preceding description, the operation of the detection mechanism is easily understood.

Figure 1:
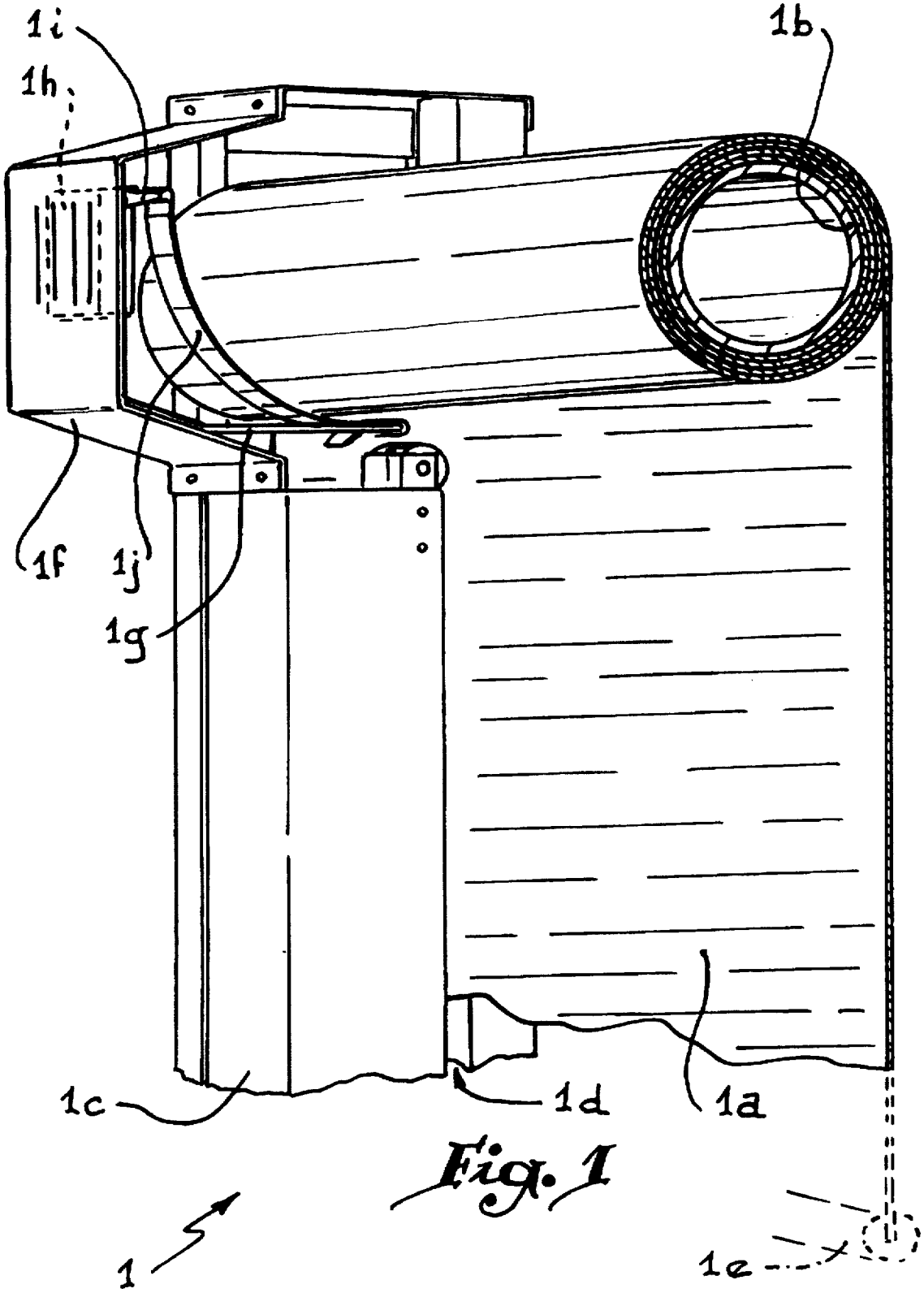
FIG. 1 is a partial view illustrating a warehouse-type roller door equipped with a detection mechanism according to the present invention.
Figure 3:
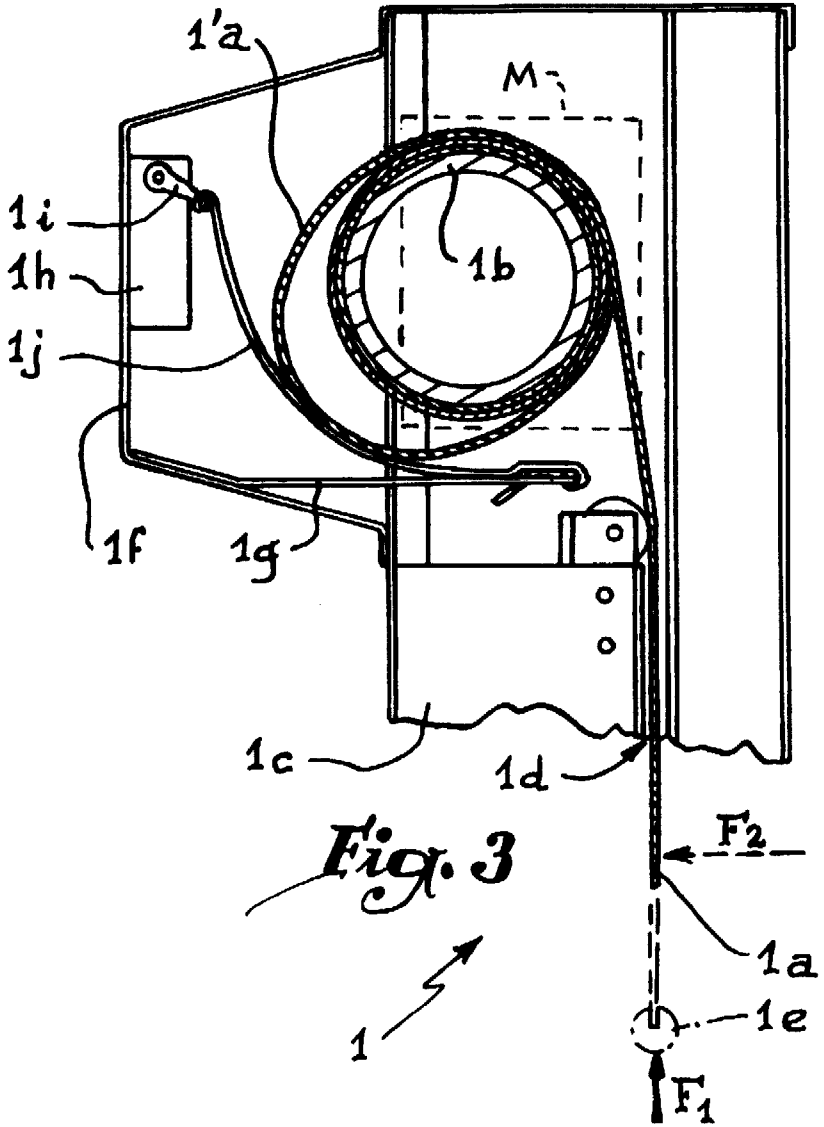
FIG. 3 is a view similar to that of FIG. 2, but showing the detection mechanism in actuated position.
Figure 2:
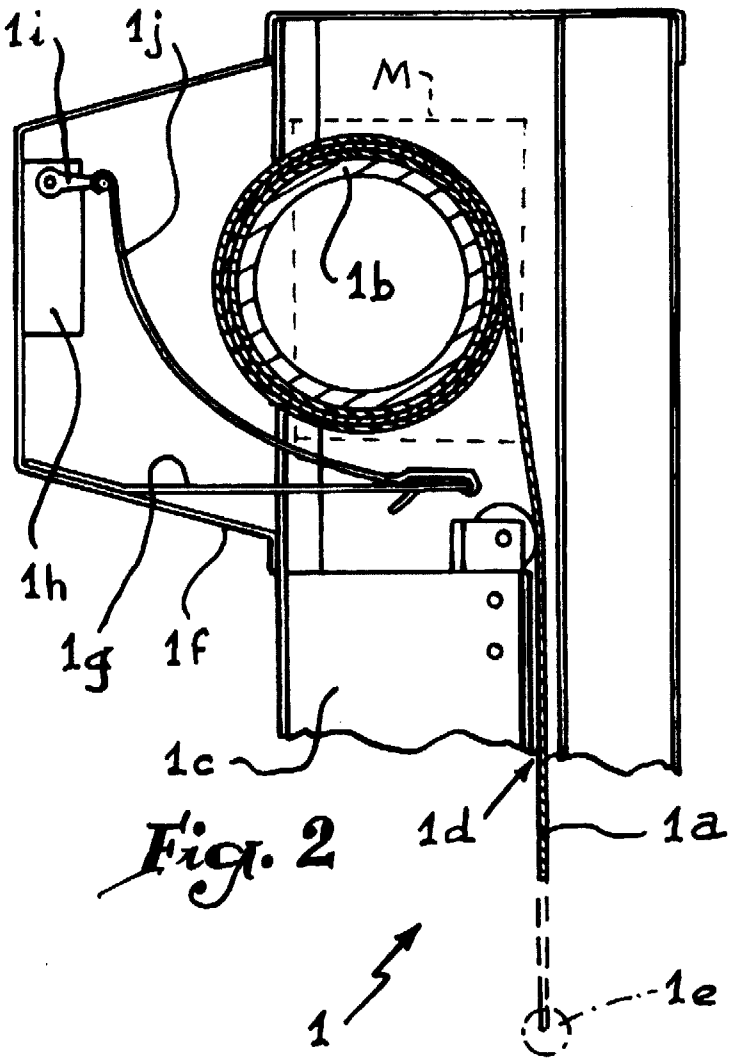
FIG. 2 is a lateral view showing the detection mechanism in initial position.

Indeed, when the sectional shutter 1*a* encounters an obstacle either under the threshold-bar 1*e*, or laterally as shown by the arrows F1 and F2 in FIG. 3, the unwinding of the shaft 1*b* forms a slack 1'*a* that comes to lean against the strap 1*j* of the safety mechanism. The moving of the safety strap 1*j* causes the swinging of the lever 1*i* actuating the position switch 1*h*. The strap 1*j* is able to receive the slack 1'*a* as shown in FIG. 3, over a broad angular sector to actuate the switch 1*h* by means of the lever 1*i*.

The position switch 1*h* controls the geared motor so that it immediately draws the shaft 1*b* in reverse direction to raise the sectional shutter 1*a*. During the raising of the sectional shutter 1*a*, the slack 1'*a* disappears and allows the strap 1*j* to return into its initial position. The strap's 1*j* return to the initial position releases the lever 1*i* that is spring-loaded and returns to its initial position. The geared motor again changes its direction of rotation so that the sectional shutter 1*a* can lower again without encountering any obstacle.

I claim:

1. A detection mechanism for terminating the lowering of a sectional shutter of a warehouse-type roller door in response to an obstacle engaging the sectional shutter as it is being unwound from about a horizontal shaft driven by a motor, the detection mechanism comprising; a switch means operatively connected to the motor, at least one strap member operatively connected to said switch means, said at least one strap member extending adjacent to the horizontal shaft and being normally spaced from the sectional shutter wound about the horizontal shaft and being positioned so as to be engaged by a slack portion of the sectional shutter created by the engagement of an obstacle with the sectional shutter as the sectional shutter is being lowered to thereby activate said switch means to control the motor and prevent further lowering of the sectional shutter by the motor.

2. The detection mechanism of claim 1 including a hood mounted in covering relationship with respect to at least a portion of the horizontal shaft, a plate extending from said hood and beneath said horizontal shaft, one end of said strap member being connected to said switch means and an opposite end of said strap member being engaged with said plate beneath the horizontal shaft, and said switch means being mounted vertically above said plate to said hood.

3. The detection mechanism of claim 2 wherein said plate extends generally perpendicular to an elongated axis of the horizontal shaft.

4. The detection mechanism of claim 2 in which said at least one strap member is arcuate in configuration between said one end and said opposite end thereof.

5. The detection mechanism of claim 4 wherein said at least one strap member extends over an angle of greater than approximately 90° with respect to the horizontal shaft.

6. The detection mechanism of claim 5 in which said switch means includes a lever, said one end of said at least one strap member being connected to said lever so as to move said lever from a first to a second position in response to the slack portion of the sectional shutter engaging said at least one strap member.

7. The detection mechanism of claim 1 wherein the horizontal shaft has opposite ends, a strap member mounted adjacent each of said opposite ends of the horizontal shaft.

8. The detection mechanism of claim 1 including a hood mounted in covering relationship with at least a portion of the horizontal shaft, said switch means being mounted to a lower portion of said hood beneath the horizontal shaft and said at least one strap member extending from one end attached to said switch means upwardly between said hood and said horizontal shaft to an opposite end connected to an upper portion of said hood.

9. The detection mechanism of claim 8 in which said at least one strap member is arcuate in configuration between said one end and said opposite end thereof.

10. The detection mechanism of claim 9 wherein said at least one strap member extends over an angle of greater than approximately 90° with respect to the horizontal shaft.

11. The detection mechanism of claim 10 in which said switch means includes a lever, said one end of said at least one strap member being connected to said lever so as to move said lever from a first to a second position in response to the slack portion of the sectional shutter engaging said at least one strap member.

12. The detection mechanism of claim 1 wherein said at least one strap member extends over an angle of greater than approximately 90° with respect to the horizontal shaft.

13. The detection mechanism of claim 12 in which said at least one strap member is arcuate in configuration between said one end and said opposite end thereof.

* * * * *